US006648255B2

(12) United States Patent
Martinez, Jr. et al.

(10) Patent No.: US 6,648,255 B2
(45) Date of Patent: Nov. 18, 2003

(54) CONICAL CRUSHER ANTI-SPIN ASSEMBLY

(75) Inventors: Joseph Paul Martinez, Jr., Waukesha, WI (US); Kenneth Lee Olson, Mendota, IL (US)

(73) Assignee: Metso Minerals Industries, Inc., Milwaukee, WI (US)

( * ) Notice: Subject to any disclaimer, the term of this patent is extended or adjusted under 35 U.S.C. 154(b) by 33 days.

(21) Appl. No.: 10/004,722

(22) Filed: Dec. 5, 2001

(65) Prior Publication Data

US 2003/0102394 A1 Jun. 5, 2003

(51) Int. Cl.[7] ..... B02C 2/06
(52) U.S. Cl. ..... 241/209
(58) Field of Search ..... 241/101.2, 207–216

(56) References Cited

U.S. PATENT DOCUMENTS 3,207,449 A 9/1965 Johnson
4,206,881 A 6/1980 Werginz
4,478,373 A 10/1984 Gieschen
4,666,092 A 5/1987 Bremer
4,892,257 A 1/1990 Stoeckmann et al.

FOREIGN PATENT DOCUMENTS

FR 2561334 * 9/1985

OTHER PUBLICATIONS

Excerpt from El Jay Rollercone Operations Manual (undated).

* cited by examiner

*Primary Examiner*—Mark Rosenbaum
(74) *Attorney, Agent, or Firm*—Foley & Lardner

(57) ABSTRACT

A cone crusher includes a frame, a shaft supported by the frame, and a head disposed on the shaft. An eccentric mechanism is coupled to the head. A one-way clutch is coupled to the shaft, and a friction torque limiting clutch is disposed within the head and coupled between the head and the one-way clutch.

23 Claims, 3 Drawing Sheets

CONICAL CRUSHER ANTI-SPIN ASSEMBLY

FIELD OF THE INVENTION

The present invention generally relates to rock crushers. More specifically, the present invention relates to an anti-spin mechanism having a torque limiter for use on a conical rock crusher.

BACKGROUND OF THE INVENTION

Rock crushers, such as cone crushers, generally include an eccentric assembly that rotates about a main shaft and imparts gyratory motion to a head assembly. Material to be crushed is loaded into a feed hopper that feeds into a bowl assembly. The material, generally rock, is crushed between a bowl liner disposed in the bowl assembly and a mantle on the crusher head assembly.

To crush rock between the head assembly and the bowl assembly, gyratory motion is imparted to the head assembly to alternately widen and narrow the gap between the head assembly and bowl assembly. The gyratory motion may be imparted via an eccentric that rotates with respect to a stationary shaft and directly imparts the eccentric motion to the head assembly. Alternatively, an eccentric assembly may be used to impart gyratory motion to a movable shaft, which in turn imparts gyratory motion to the head assembly. In either case, a frame supports the shaft and head assembly, and a countershaft or other driving mechanism is utilized to drive the eccentric assembly.

The eccentric generally rotates at a high rate of speed (e.g., 200 rpm). Although the interface between the eccentric and the head is lubricated and generally includes a bushing disposed between the two components, without counteracting forces preventing the movement, the head tends to rotate along with the eccentric.

When the crusher is operating and crushing rock (at-load), the head rotates slowly in a direction opposite to the eccentric direction of rotation due to the countervailing forces of the material being crushed. However, during no-load operation (eccentric rotating but no rock being crushed), the head tends to rotate in the direction of the eccentric. Such rotation is not desirable because rock can degrade the crushing surface of the head as the head transitions from rotating in the direction of the eccentric during no-load operation to the opposite rotation of normal crushing operation. Further, improper introduction of rock into a machine can cause ejection of the rock from the machine when the head is rotating at a high rate of speed.

Certain rock crushers include an anti-spin mechanism to prevent undesirable rotation during no-load conditions. The anti-spin mechanism may be a one-way clutch, such as a backstop clutch, that prevents rotation of the head in the direction of eccentric travel but permits travel of the head in the opposite direction during normal crusher operation.

During certain operational circumstances, a large torque driving the head in the direction of eccentric travel may be encountered. For example, a head bushing may fail, thus causing substantial friction between the head and eccentric, forcing the head to travel in the direction of the eccentric. Further, during no-load operation, a rock may fall between the head and bowl and impart a crushing force on the head that has a component in the direction of eccentric travel. Moreover, during at-load crushing operations, certain rock configurations may be encountered that result in a large torque on the head being generated in the direction of the eccentric. In all of these circumstances, a backstop clutch may be at risk for rupture, as the backstop clutch is designed to prevent the head from rotating in the direction of the eccentric during no-load operation, but is not designed to withstand excessive reverse torque loads. Even if the backstop clutch does not fail, other crusher components are at risk for damage due to the unusual torque load.

There is no backstop clutch design for use in rock crushers that has free motion in one rotational direction and a friction clutch torque limit to prevent excess torque in the locked direction. Even if a backstop clutch were designed to incorporate such functionality, the head would have to be removed to service the device. Replacing the backstop clutch with a friction plate torque limiting clutch would be disadvantageous because of the continuous rotation present during at-load operation. The continuous rotation would cause excessive wear on the clutch, resulting in an unacceptably short component service life.

Secondary mechanisms such as shear pins can be utilized to protect the one-way backstop clutch. However, the available space within the head assembly of a conventional rock crusher is limited, presenting design challenges for the device utilized to protect the one-way clutch.

Certain conventional crusher designs utilize shear pins or bolts to protect the backstop clutch. The shear pins permit rotation of the head in the direction of the eccentric by shearing off in response to unusually large torque events in the direction of the eccentric, thus protecting the backstop clutch and other crusher components. However, the utilization of shear pins to protect the one-way clutch presents operational difficulties, as failed shear pins must be replaced after each occurrence of an excessive reverse torque loading. The increased crusher inoperability adds to the overall operation and maintenance costs of a crusher installation.

Another method of protecting the one-way clutch utilizes a torque limiter coupled to the clutch. U.S. Pat. No. 4,666,092 to Bremer, issued May 18, 1987, discloses such a device. The Bremer device utilizes a resetting torque limiter that permits rotation of the crusher head in the direction of the eccentric in the case of excessive torque on the clutch. Thus, the Bremer design eliminates the necessity of shear pins.

During normal operation, the Bremer torque limiter prevents rotation of the crushing head relative to the one-way clutch by utilizing a number of balls forced into corresponding detents by compression springs. Upon an overload exceeding the torque limit of the torque limiter, the balls are forced out of the detents and the torque limiter permits rotation of the head relative to the one-way clutch until the balls are reset into the detents.

A disadvantage of the Bremer device is that the balls may snap into and out of the detents several times before the torque limiter resets, causing multiple shocks to the crusher drive train before the balls properly reset and prevent rotation of the head relative to the one-way clutch. Further, the Bremer device does not continuously dissipate energy to slow down head travel in the direction of the eccentric in the case of unusual torque loadings, as the torque limiter is not a friction clutch device. Accordingly, once the Bremer device begins to rotate, the crushing head may not stop spinning until the crusher is placed at load for a period of time to allow the device to reset. A further disadvantage of the Bremer device is that both the one-way clutch and torque limiter are coupled to the head, such that both devices gyrate along with the head, which can prevent proper engagement of the springs in the one-way clutch.

U.S. Pat. No. 4,206,881 to Werginz, issued Jun. 10, 1980, utilizes a hydraulic motor as an anti-spin mechanism. The hydraulic system does not require shear pins or a torque limiter. Instead, the hydraulic motor is designed to rotate in the direction of the eccentric in the case of a reverse torque overload. However, the hydraulic system requires additional hydraulic components, adding size, expense and complexity to the anti-spin mechanism.

Accordingly, there is a need for a rock crusher that includes an anti-spin mechanism that does not utilize shear pins to protect a one-way clutch. Further, there is a need for an anti-spin mechanism that does not utilize a hydraulic motor or pump. Further still, there is a need for an anti-spin mechanism that permits the one-way clutch to remain stationary during normal crusher operation, rather than gyrating along with the crusher head. Further still, there is a need for an anti-spin mechanism that includes a torque limiting mechanism that both protects the one-way clutch and fits into the small space allowed within the crusher head assembly. Yet further still, there is a need for a device to protect a one-way clutch that provides continuous braking once an excessive reverse torque loading passes, to dissipate the energy of the rotating head and bring the head to a stop.

It would be desirable to provide a system and/or method that provides one or more of these or other advantageous features. Other features and advantages will be made apparent from the present specification. The teachings disclosed extend to those embodiments that fall within the scope of the appended claims, regardless of whether they accomplish one or more of the aforementioned needs.

SUMMARY OF THE INVENTION

One embodiment relates to a cone crusher. The cone crusher includes a frame, a shaft supported by the frame, and a head disposed on the shaft. An eccentric mechanism is coupled to the head and a one-way clutch is coupled to the shaft. A friction torque limiting clutch is disposed within the head and is coupled between the head and the one-way clutch.

Another embodiment relates to an anti-spin mechanism for a rock crusher having a head, an eccentric, and a shaft. The anti-spin mechanism includes a one-way clutch coupled to the shaft. The one-way clutch permits rotation of the head in a first direction and inhibits rotation of the head in a second direction. A friction torque limiting clutch is disposed within the head and is coupled to the one-way clutch. The friction torque limiting clutch protects the one-way clutch by permitting rotation of the head in the second direction in the case of an excessive torque load.

A further embodiment relates to a rock crusher having a stationary shaft and a head coupled to the shaft. The head is driven in a gyratory manner by an eccentric. A lower spindle extends from the shaft, and a backstop clutch is coupled to the lower spindle. An upper spindle is coupled to the backstop clutch, and a friction torque limiting clutch is coupled between the upper spindle and the head.

A still further embodiment relates to a rock crusher having a head and a stationary shaft. The rock crusher includes means coupled between the head and the shaft for permitting rotation of the head in only one direction. The rock crusher further includes means for limiting the torque on the means for permitting rotation of the head in only one direction. The means for limiting the torque includes a number of plates that frictionally engage one another.

A still further embodiment relates to a method of performing maintenance on a rock crusher having a one-way clutch coupled to a torque limiter disposed within a head assembly beneath a feed plate and a top plate. The top plate is fastened to the head assembly and the torque limiter. The method includes the steps of removing the feed plate, unfastening the top plate from the head assembly, and lifting the torque limiter out of the head assembly.

Alternative embodiments of the invention relate to other features and combinations of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION OF THE PREFERRED EMBODIMENTS

Figure 1:
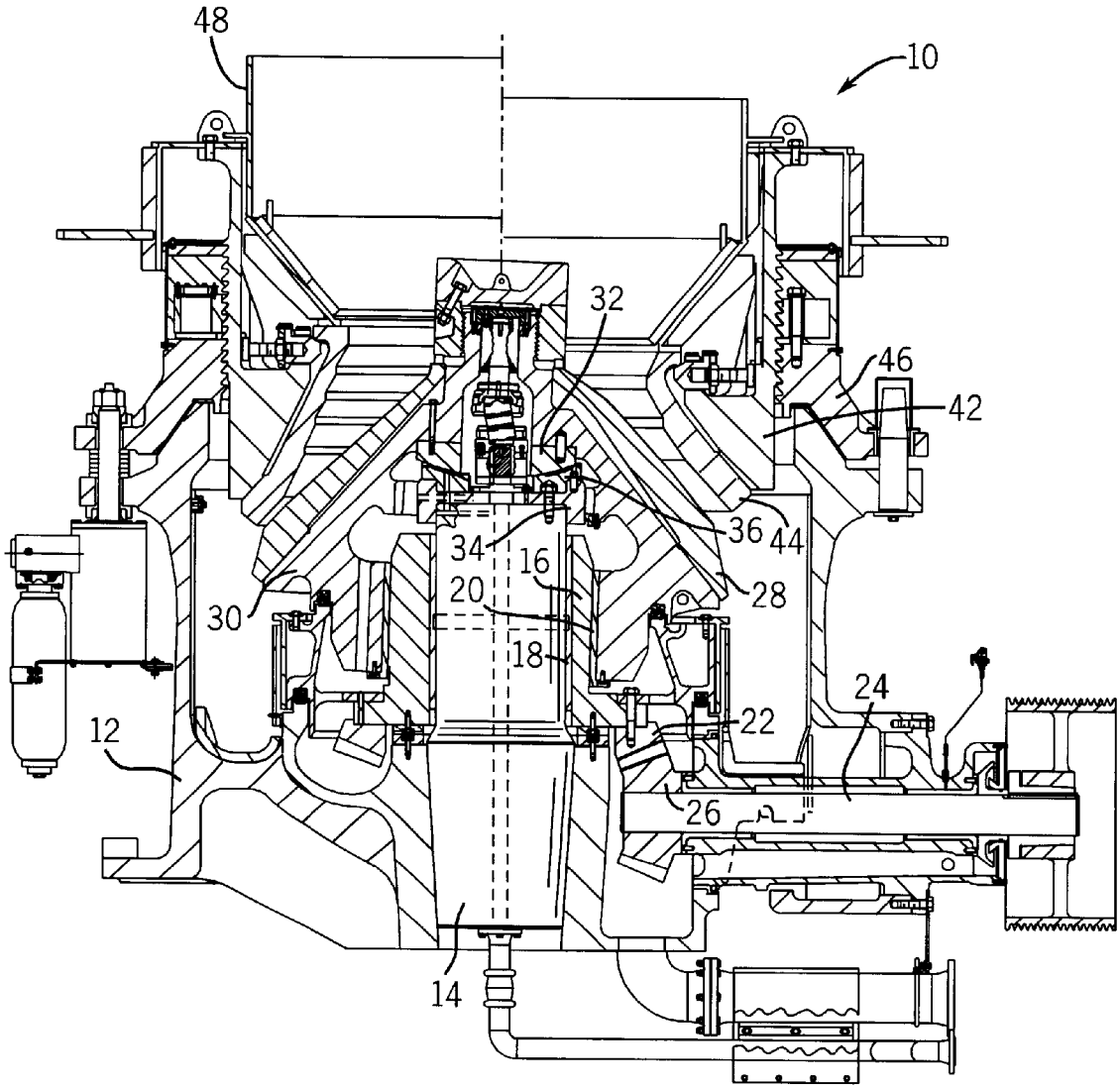
FIG. 1 is a cross sectional view of a rock crusher.

Referring to FIG. 1, a crusher 10 includes a main frame 12 that supports the components of the crusher 10 including a main shaft 14. FIG. 1 shows a standard size of the crusher 10 on the left, and a short head size on the right. In the embodiment depicted in FIG. 1, the main shaft 14 is stationary and an eccentric 16 is rotatably disposed about the main shaft 14. The eccentric 16 rotates with an eccentric bushing 18 about main shaft 14.

Figure 2:
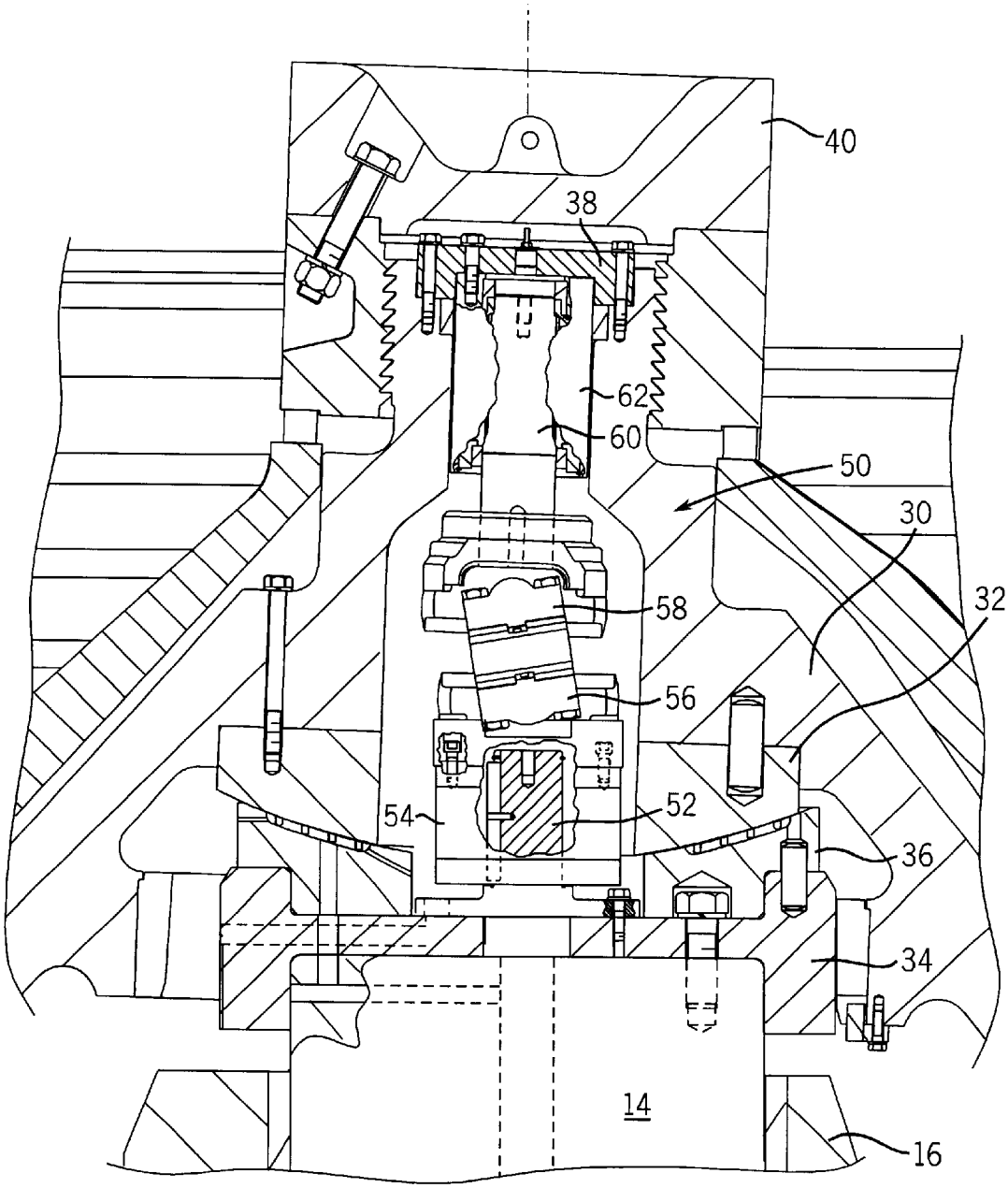
FIG. 2 is a more detailed sectional view of the rock crusher illustrated in FIG. 1 with partial cut-away views detailing portions of an anti-spin mechanism.

Crusher 10 can be embodied as a conical crusher manufactured by Metso Minerals (Milwaukee) Inc., such as an MP™ Series cone crusher modified to include an advantageous anti-spin mechanism 50 (FIG. 2). The type of rock crusher and its various components are not described in limiting fashion. The principles of anti-spin mechanism 50 can be applied to any crusher apparatus in which an anti-spin mechanism is desirable.

A gear 22 is fixed to the eccentric 16 and is driven by a countershaft 24 having a pinion 26 engaged with gear 22. The countershaft 24 may be driven by any suitable motor force.

A head 30 is disposed above main shaft 14 and includes a head ball 32 that is axially supported in a socket 34 and socket liner 36 disposed on main shaft 14. A head bushing 20 is rotatably coupled to eccentric 16 and transmits motion from eccentric 16 to head 30. Head 30 includes a mantle 28 that serves as a crushing surface.

A bowl 42 supported by main frame 12 includes a bowl liner 44 that serves as a crushing surface opposite mantle 28. An adjustment ring 46 permits vertical adjustment of bowl 42 to change the gap between bowl liner 44 and mantle 28, thus changing the crusher 10 setting.

A feed hopper 48 serves as a receptacle for the input of rock to be crushed, and feeds the rock into the gap between mantle 28 and bowl liner 44.

In operation, countershaft 24 drives eccentric 16 to impart gyratory motion to head 30. Material to be crushed is fed into feed hopper 48, is crushed between mantle 28 and bowl liner 44, and exits out of crusher 10.

Referring to FIG. 2, anti-spin mechanism 50 is disposed within head 30. A lower spindle 52 extends upwardly from main shaft 14, and is disposed within a one-way clutch, shown as, but not limited to backstop clutch 54. Backstop clutch 54 may utilize any of a number of conventional methods of permitting rotation in one direction but not in the opposite direction. A set of universal joints, lower U-joint 56 and upper U-joint 58, are coupled between backstop clutch 54 and an upper spindle 60. Upper spindle 60 is disposed within a torque limiting clutch, shown as friction torque limiting clutch 62.

Further referring to FIG. 2, a top plate 38 is bolted to friction torque limiting clutch 62 and to head 30. A feed plate 40 is disposed over the top plate 38.

In an exemplary embodiment, during at-load crusher 10 operation, backstop clutch 54 remains radially constrained with respect to the longitudinal axis of lower spindle 52. Backstop clutch 54 permits normal rotation of head 30 in a direction opposite to the rotational direction of eccentric 16. The universal joints, lower U-joint 56 and upper U-joint 58, accommodate head 30 motion so that only torque is transmitted between backstop clutch 54 and friction torque limiting clutch 62.

Figure 3:
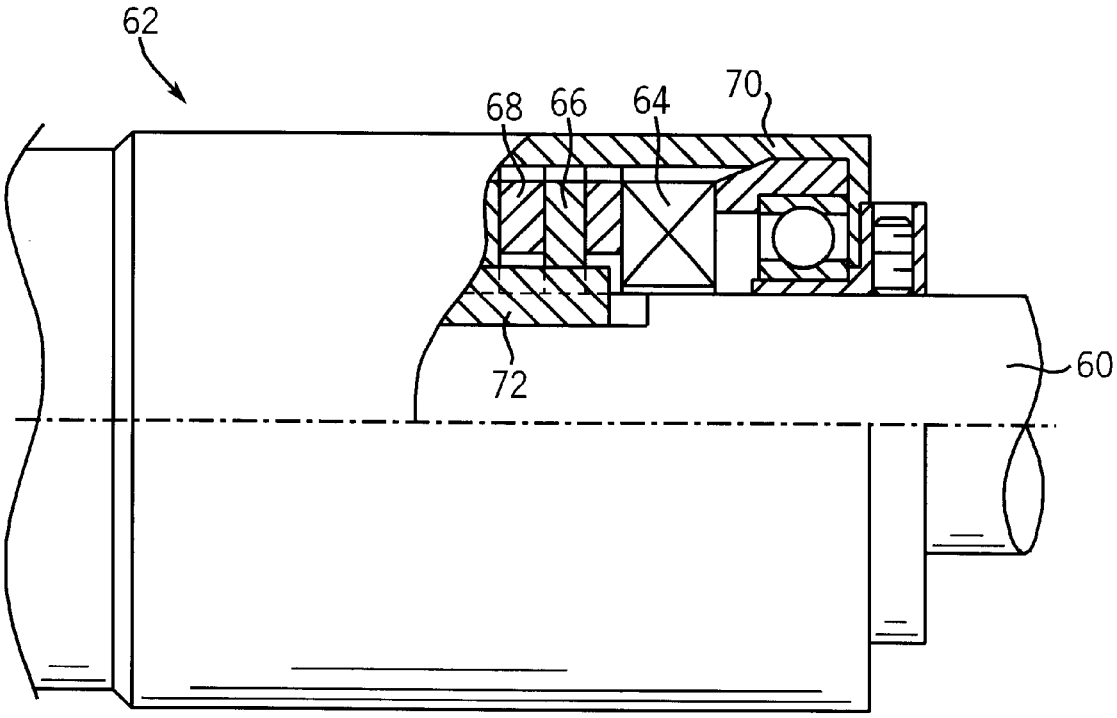
FIG. 3 is a more detailed cut-away front view of a friction torque limiting clutch for use in the anti-spin mechanism illustrated in FIG. 2.

Referring to FIG. 3, friction torque limiting clutch 62 includes a number of springs 64 that compress a series of friction plates 66 and separators 68. The friction torque limiting clutch 62 may be set at differing torque set points to permit rotation of upper spindle 60 relative to a housing 70 in the case of a torque overload. As long as the torque exceeds the set point, friction plates 66 will slip relative to separators 68, while continuing to transmit torque equal to the torque set point. Upper spindle 60 includes splines 72 that are keyed to friction plates 66 but not to separators 68, which are fixed to housing 70.

Referring again to FIGS. 1 and 2, during normal at-load crusher 10 operation, head 30 slowly rotates in a direction opposite that of eccentric 16. During no-load operation, wherein head 30 would rotate in the direction of eccentric 16 were it not prevented from doing so, backstop clutch 54 prevents such head rotation. Friction torque limiting clutch 62 is set such that head 30 does not rotate in the direction of eccentric 16 during normal no-load operation, as the friction set point between friction plates 66 and separators 68 is not overcome by the torque generated by the friction between eccentric 16 and head 30 via head bushing 20. During both at-load and no-load operation, upper spindle 60 does not rotate with respect to housing 70 of friction torque limiting clutch 62.

During certain circumstances, an unusual reverse torque loading will be encountered, whereby head 30 is driven in the direction of the eccentric 16 by a greater than normal force. Such an excessive reverse torque load may be due to a head bushing 20 failure, an unusual rock loading during the transition from no-load to at-load operation, or by a large rock that imparts a torque in the direction of the eccentric 16 during at-load operation. The backstop clutch 54 will not permit rotation of head 30 in the direction of eccentric 16, but if the excessive reverse torque loading exceeds the set point of friction torque limiting clutch 62, housing 70 will rotate with respect to upper spindle 60, permitting movement of head 30 in the direction of eccentric 16, thus preventing the, possible rupture of backstop clutch 54 or damage to other crusher 10 components. In one embodiment, the set point of the friction torque limiting clutch for a Metso Minerals MP800 crusher is 10,170 N-m or 7,500 ft-lbs.

As long as the excessive reverse torque loading exceeds the set point of friction torque limiting clutch 62, head 30 is permitted to rotate in the direction of eccentric 16. Once the excessive reverse torque loading has ceased, the friction between friction plates 66 and separators 68 slows the motion of head 30 until the differential rotation between housing 70 and upper spindle 60 ceases. Accordingly, at no time is the head 30 permitted to "freewheel" along with eccentric 16, as is the case for conventional crusher designs utilizing a non friction-based torque limiter.

Friction torque limiting clutch 62 may be procured from any number of industry suppliers. One such supplier of torque limiting clutches is Power Transmission Technology, Inc., of Sharon Center, Ohio. In particular, the friction torque limiting clutch 62 may be a Power Transmission Technology CMD Series compact multiple disk friction torque limiter, such as model CMD 162-12-103, which includes bushings that limit the radial motion of upper spindle 60 within friction torque limiting clutch 62 during crusher 10 operation.

Because the set of universal joints 56, 58 is disposed between backstop clutch 54 and friction torque limiting clutch 62, backstop clutch 54 may be disposed directly on stationary main shaft 14, thus eliminating the difficulties associated with subjecting backstop clutch 54 to gyrating motion.

In an exemplary embodiment, universal joints 56 and 58 may be procured from a supplier of power transmission components, such as from Johnson Power Ltd. of Broadview, Ill. In particular, the universal joints may be Series FL90W universal joints.

Friction torque limiting clutch 62 has a compact design permitting placement of friction torque limiting clutch 62 within head 30 as depicted in FIGS. 1 and 2. Further, expenses are saved through the utilization of a friction-based clutch system rather than a hydraulic system that would necessitate further hydraulic support components.

A further advantage of the friction torque limiting clutch 62 relates to the calibration of the crusher 10 setting. An automation package may be used to calibrate the crusher 10 setting. The crusher 10 setting is calibrated by rotating the bowl 42 to reduce the gap between the mantle 28 and the bowl liner 44 to zero when the crusher 10 is at rest. Crusher designs that include shear pins as a torque limiting mechanism are not suited for such automated calibration, as the torque generated by the contact of the bowl liner 44 against the mantle 28 rotates the head 30 in the direction of the eccentric 16, thus resulting in failed shear pins. The present invention permits automated calibration because the friction torque limiting clutch 62 permits rotation of the head 30 with the bowl 42 once the mantle 28 and bowl liner 44 contact one another. Thus, anti-spin capability is successfully combined with automatic crusher 10 setting calibration.

In an exemplary embodiment, anti-spin mechanism 50 is utilized on an MP™ Series crusher manufactured by Metso Minerals (Milwaukee) Inc. Anti-spin mechanism 50 is not limited to use with such crushers, however, and may be utilized with respect to other rock crushers that have a need for an anti-spin mechanism 50.

Preferably, friction torque limiting clutch 62 may be serviced without removing head 30 from crusher 10. Referring to FIG. 2, one method for performing such "top surface" involves first removing the feed plate 40, which may be bolted in place. Next, the top plate 38 is unfastened from head 30. Once top plate 38 has been unfastened from head 30, the top plate 38 along with friction torque limiting clutch 62 may be removed from within head 30 by sliding top plate 38 and friction torque limiting clutch 62 off upper spindle 60. Alternatively, top plate 38 may first be unbolted from friction torque limiting clutch 62 and removed from head 30 before accessing and/or removing friction torque limiting clutch 62.

The ability to access and remove friction torque limiting clutch 62 from crusher 10 without removing head 30 is advantageous because overall maintenance time is reduced. Accordingly, "top surface" is advantageous as compared to crusher 10 designs that require removal of head 30 to service any torque limiter housed therein.

While the detailed drawings and specific examples given describe preferred and exemplary embodiments of the invention, they serve the purpose of illustration only. The inventions disclosed are not limited to the specific form shown. For example, backstop clutch 54 may have differing mechanical configurations depending on the crusher application. Further, the linkage between backstop clutch 54 and friction torque limiting clutch 62 may differ depending on the particular crusher application. The crusher configurations shown and described may differ depending on the chosen performance characteristics and physical characteristics of the rock crushers. Furthermore, other substitutions, modifications, changes, and omissions may be made in the design, operating conditions, and arrangement of the exemplary embodiments without departing from the scope of the invention as expressed in the appended claims.

What is claimed is:

1. A cone crusher, comprising:

a frame;

a shaft supported by the frame;

a head disposed on the shaft;

an eccentric mechanism coupled to the head;

a one-way clutch coupled to the shaft; and a friction torque limiting clutch disposed within the head and coupled between the head and the one-way clutch.

2. The cone crusher of claim 1, further comprising a set of universal joints coupled between the one-way clutch and the friction torque limiting clutch.

3. The cone crusher of claim 2, wherein the set of universal joints includes two universal joints.

4. The cone crusher of claim 3, wherein the one-way clutch is a backstop clutch.

5. The cone crusher of claim 2, wherein the one-way clutch is coupled to a spindle extending from the shaft, whereby the one-way clutch is radially constrained with respect to a longitudinal axis of the shaft.

6. The cone crusher of claim 2, wherein the friction torque limiting clutch comprises:

a housing;

a plurality of separators secured to the housing;

a plurality of friction plates disposed adjacent the separators; and a number of springs compressing the separators and the friction plates.

7. The cone crusher of claim 6, wherein the friction torque limiting clutch has a torque set point, above which the friction plates and the separators travel with respect to one another.

8. The cone crusher of claim 7, wherein the friction between the friction plates and the separators continuously retards travel with respect to one another.

9. An anti-spin mechanism in combination with a rock crusher having a head, an eccentric, and a shaft, comprising:

a one-way clutch coupled to the shaft, the one-way clutch permitting rotation of the head in a first direction, and inhibiting rotation of the head in a second direction; and a friction torque limiting clutch disposed within the head and coupled to the one-way clutch, wherein the friction torque limiting clutch protects the one-way clutch by permitting rotation of the head in the second direction in the case of an excessive torque loading.

10. The anti-spin mechanism of claim 9, further comprising a set of universal joints coupled between the one-way clutch and the friction torque limiting clutch.

11. The anti-spin mechanism of claim 10, wherein the one-way clutch is a backstop clutch.

12. The anti-spin mechanism of claim 10, wherein the one-way clutch is coupled to a spindle extending from the shaft, whereby the one-way clutch is radially fixed with respect to the shaft.

13. The anti-spin mechanism of claim 9, wherein the friction torque limiting clutch comprises:

a housing;

a plurality of separators secured to the housing;

a plurality of friction plates disposed adjacent to the separators; and a number of springs compressing the separators and the friction plates.

14. The anti-spin mechanism of claim 13, wherein the friction torque limiting clutch has a torque set point, above which the friction plates and the separators slip with respect to one another.

15. The anti-spin mechanism of claim 14, wherein the friction torque limiting clutch continuously brakes the head as long as the head travels in the second direction.

16. A rock crusher, comprising:

a stationary shaft;

a head coupled to the shaft, the head driven in a gyratory manner by an eccentric;

a lower spindle extending from the shaft;

a backstop clutch coupled to the lower spindle;

an upper spindle coupled to the backstop clutch; and a friction torque limiting clutch coupled between the upper spindle and the head.

17. The rock crusher of claim 16, further comprising a set of universal joints coupled between the backstop clutch and the friction torque limiting clutch.

18. The rock crusher of claim 17, wherein the friction torque limiting clutch comprises:

a housing;

a plurality of separators secured to the housing;

a plurality of friction plates disposed adjacent the separators; and a number of springs compressing the separators and the friction plates.

19. The rock crusher of claim 18, wherein the friction torque limiting clutch has a torque set point, above which the friction plates and the separators slip with respect to one another.

20. The rock crusher of claim 16, wherein the rock crusher is a cone crusher.

21. A rock crusher, comprising:

ahead;

a stationary shaft;

means coupled between the head and the shaft for permitting rotation of the head in only one direction; and means for limiting the torque on the means for permitting rotation of the head in only one direction, the means for limiting the torque comprising a number of plates that frictionally engage one another.

22. The rock crusher of claim 21, wherein the means for permitting rotation of the head in only one direction is a backstop clutch.

23. The rock crusher of claim 21, wherein the means for limiting the torque is a friction torque limiting clutch.

* * * * *